US005961338A

United States Patent [19]

Wu et al.

[11] Patent Number: 5,961,338

[45] Date of Patent: Oct. 5, 1999

[54] IC CARD CONNECTOR

[75] Inventors: Kun-Tsan Wu, Tu-Chen; Steven Wang, Pan-Chiao, both of Taiwan

[73] Assignee: Hon Hai Precision Ind. Co., Ltd., Taipei Hsien, Taiwan

[21] Appl. No.: 09/009,589

[22] Filed: Jan. 20, 1998

Related U.S. Application Data

[63] Continuation of application No. 08/582,937, Jan. 4, 1996, abandoned.

[51] Int. Cl.[6] ..... H01R 13/62

[52] U.S. Cl. ..... 439/326

[58] Field of Search ..... 439/326–328, 439/629–637, 312

[56] References Cited

U.S. PATENT DOCUMENTS 4,810,203 3/1989 Komatsu ..... 439/326

4,820,186 4/1989 Fujii ..... 439/326

5,337,220 8/1994 Granitz ..... 439/326

*Primary Examiner*—Hien Vu

[57] ABSTRACT

An electrical connector (10) for receiving an IC card (100) therein, includes a base (12) joined with a cover (42). A plurality of contacts (16) are disposed in the base (12) wherein the engagement portion (20) of each contact (16) protrudes out of an upper surface (22) of the base (12) for engagement with the contact pads on the IC card (100). The cover (42) includes a pair of holding slots (52) on two sides for carrying the inserted IC card (100) to rotatably move with the cover (42) when the cover (42) is pivoted from a slanted position to a horizontal position. The cover (42) further includes a pushing bar (54) which is adapted to carry the inserted IC card (100) to horizontally move with the cover (42) when the cover (42)is horizontally moved from the rear position to the front position.

6 Claims, 7 Drawing Sheets

IC CARD CONNECTOR (This application is a continuation of application Ser. No. 08/582,937 filed on Jan. 4, 1996, now abandoned).

BACKGROUND OF THE INVENTION

1. Field of the Invention

The invention relates to IC card connectors, and particularly to the connector for use with a card-like subscriber identity module.

2. The Prior Art

IC cards have been popularly used in the data processing field for several years. Generally, a socket or a connector which is mounted on the mother board, is designed to receive such IC card therein for interconnection between the IC card and the PC board. The technical considerations for such socket or connector designs may include how to easily load the IC card to the corresponding socket or connector, and how to assure a reliable and superior mechanical and electrical engagement may be obtained when the IC card is fully or completely embedded within the connector. The standardized memory card connectors may be referred to U.S. Pat. No. 5,286,207. Moreover, other different or non-standard IC cards may be alternatively used in different manners with different type connectors for different applications, for example, U.S. Pat. Nos. 4,843,223, 4,902,233, 5,224,873, 5,320,552, 5,337,220 and 5,425,651.

An object of the invention is to provide an electrical connector for receiving a SIM (Subscriber Identity Module) therein.

Another object of the invention is to have such SIM connector have a simplified structure not only for easy loading of the corresponding module therein but also for better and reliable engagement between such module and the connector.

SUMMARY OF THE INVENTION

According to an aspect of the invention, an electrical connector for receiving an IC card therein, includes a base joined with a cover. A plurality of contacts are disposed in the base wherein the engagement portion of each contact protrudes out of an upper surface of the base for engagement with the contact pads on the IC card. The cover includes a pair of holding slots on two sides for carrying the inserted IC card to rotatably move with the cover when the cover is pivoted from a slanted position to a horizontal position with regard to the base. The cover further includes a pushing bar which is adapted to carry the inserted IC card to horizontally move with the cover when the cover is horizontally moved from the rear position to the front position.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
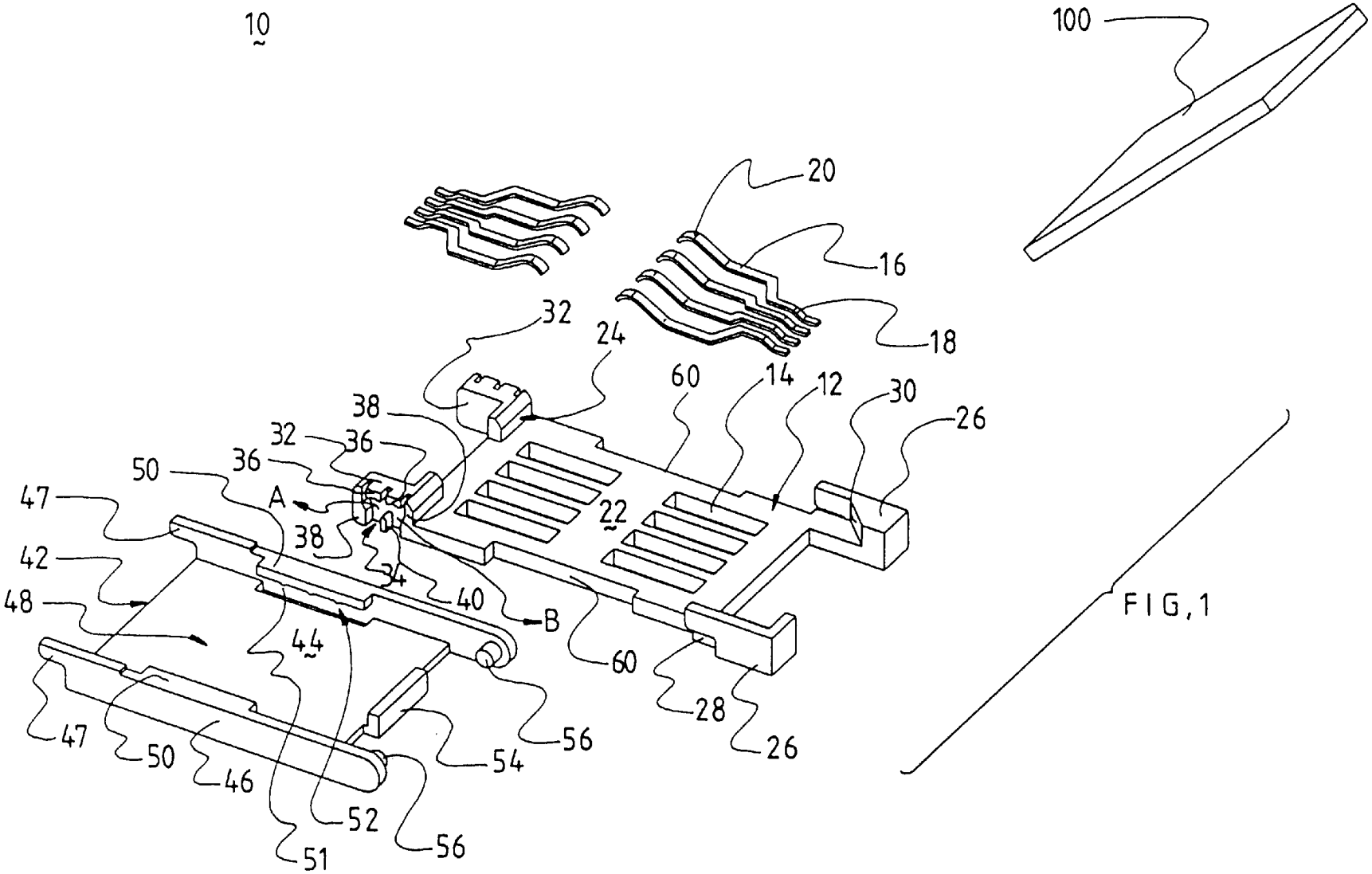
FIG. 1 is an exploded perspective view of the present preferred embodiment of an electrical connector for use with an IC card aside, according to the invention, wherein the cover is disposed in an upside down manner for easy illustration.
Figure 2:
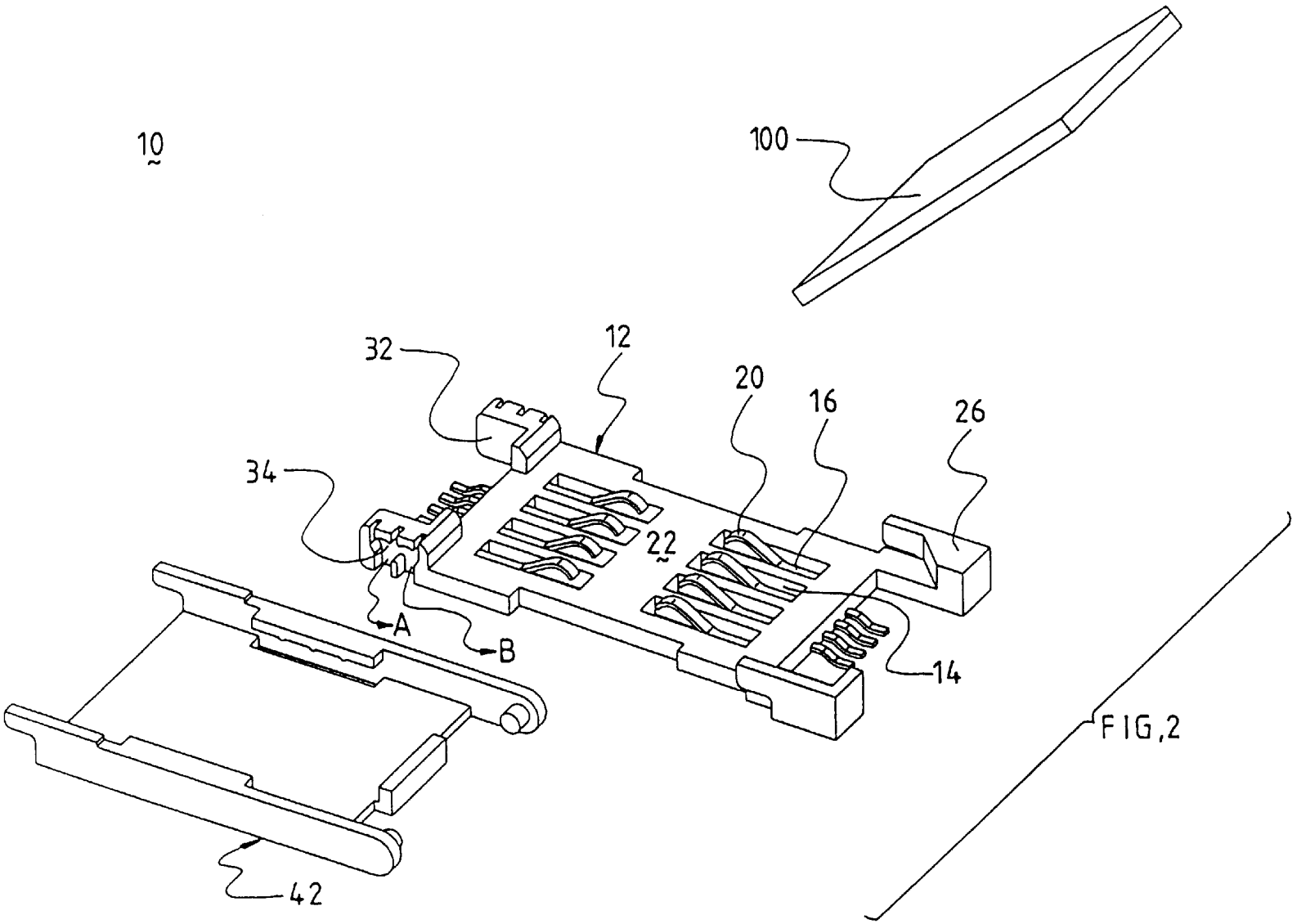
FIG. 2 is a perspective view of the connector and the IC card of FIG. 1 wherein the contacts have been installed within the base.
Figure 3:
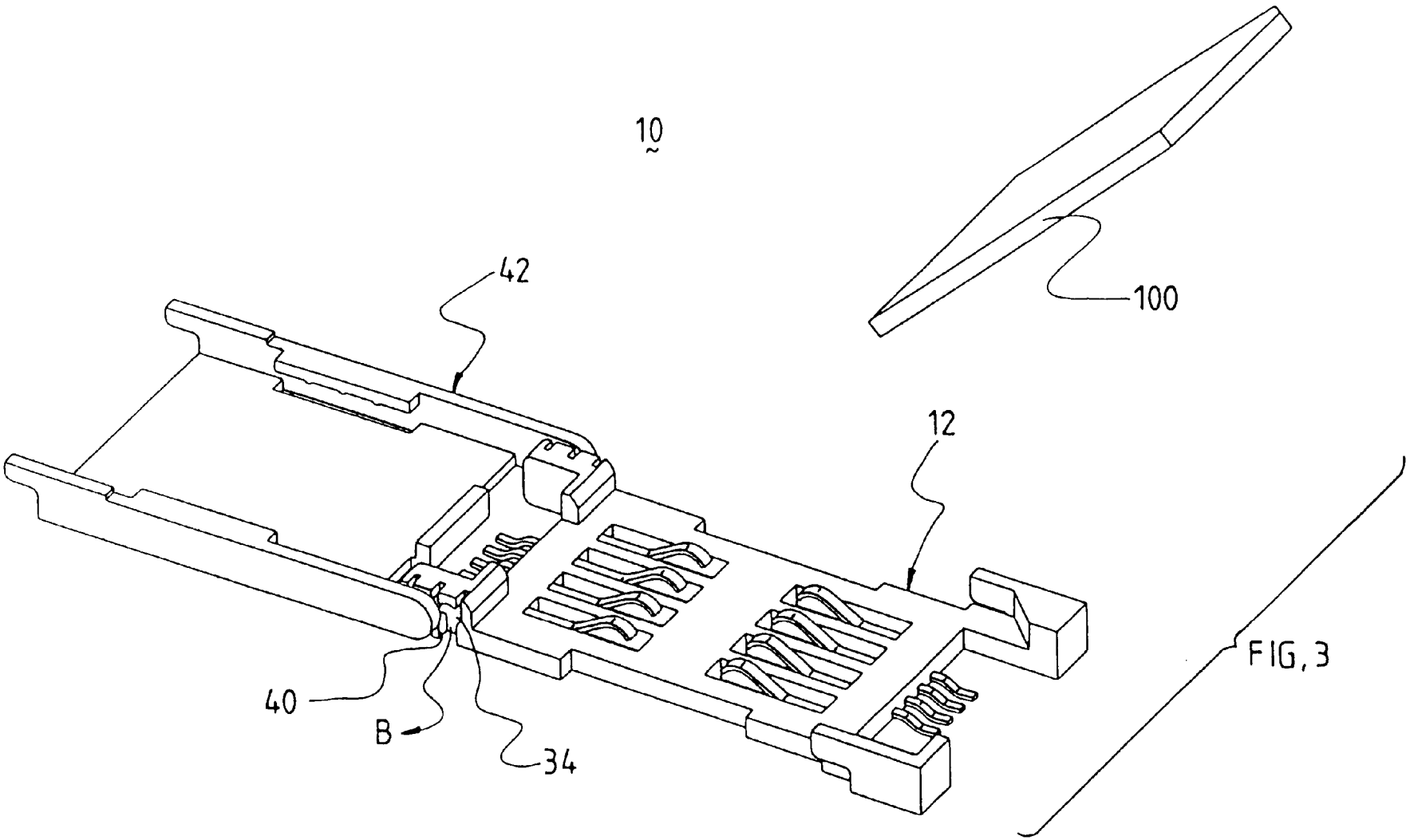
FIG. 3 is a perspective view of the assembled connector and the IC card of FIG. 1 wherein the cover is in a horizontally and fully opened state with regard to the base.

It will be noted here that for a better understanding, most of like components are designated by like reference numerals throughout the various figures in the embodiments. Attention is directed to FIGS. 1–3, an electrical connector 10 includes a base 12 having a plurality of passageways 14 for receiving a corresponding number of contacts 16 therein. In this embodiment, such contacts 16 are assembled to the base 12 through an insert molding process, i.e., being integrally molded with the base 12. Each contact 16 has a tail portion 18 extending outward from the base for mounting on the board (not shown). Oppositely, an engagement portion 20 of the contact 16 extends out of the corresponding passageway 14 and beyond the upper surface 22 of the base 12 and into the cavity 24 defined in the base 12.

A pair of restraint blocks 26 are formed on the front portion of the base 12 wherein each block 26 has an indent 28 (only one shown) on the underside of the outer portion, and one of the blocks 26 has a chamfer region 30 on the inner portion. Oppositely, a pair of piers 32 are located on the rear portion of the base 12 wherein each pier 32 has a recess 34 (only one shown) which is defined by a pair of arc top walls 36, a pair of converged side walls 38 and a raised center bottom peg 40. Thus, a narrowed waist shape is formed in the recess 34 along a front-to-back direction.

Corresponding to the base 12, a cover 42 is attachably fastened to the base 12. The cover 42 includes a plate 44 and two side arms 46 commonly defining a space 48 therein. Each arm 46 further includes a holding strap 50 integrally horizontally inwardly extending from the bottom edge thereof to define a slot 52 therein. A pushing bar 54 downward extends from the rear edge thereof. Corresponding to the recesses 34 in the base 12, a pair of rotation shafts 56 are respectively inward formed adjacent to the rear ends of the side arms 46. Also, corresponding to the indents 28 of the base 12, a pair of restriction projections 47 are formed on the front portion of the cover 42.

As mentioned earlier, the contacts 16 are integrally molded with the base 12 through an insert molding process, as shown in FIG. 2. Then, the cover 42 is attached to the base 12 under the condition that such pair of rotation shafts 56 are respectively snugly received within the corresponding recesses 34 in the base 12. It should be noted that such shaft 56 is designedly arranged in the rear portion A (as shown by arrow A) of the recess 34, i.e., the space behind the center peg 40 as shown in FIG. 3. In this situation, the cover 42 can be rotatably moved with regard to the base 12 by means that the rotation shaft 56 of the cover 42 is pivotable within the portion A of the recess 34.

Figure 4:
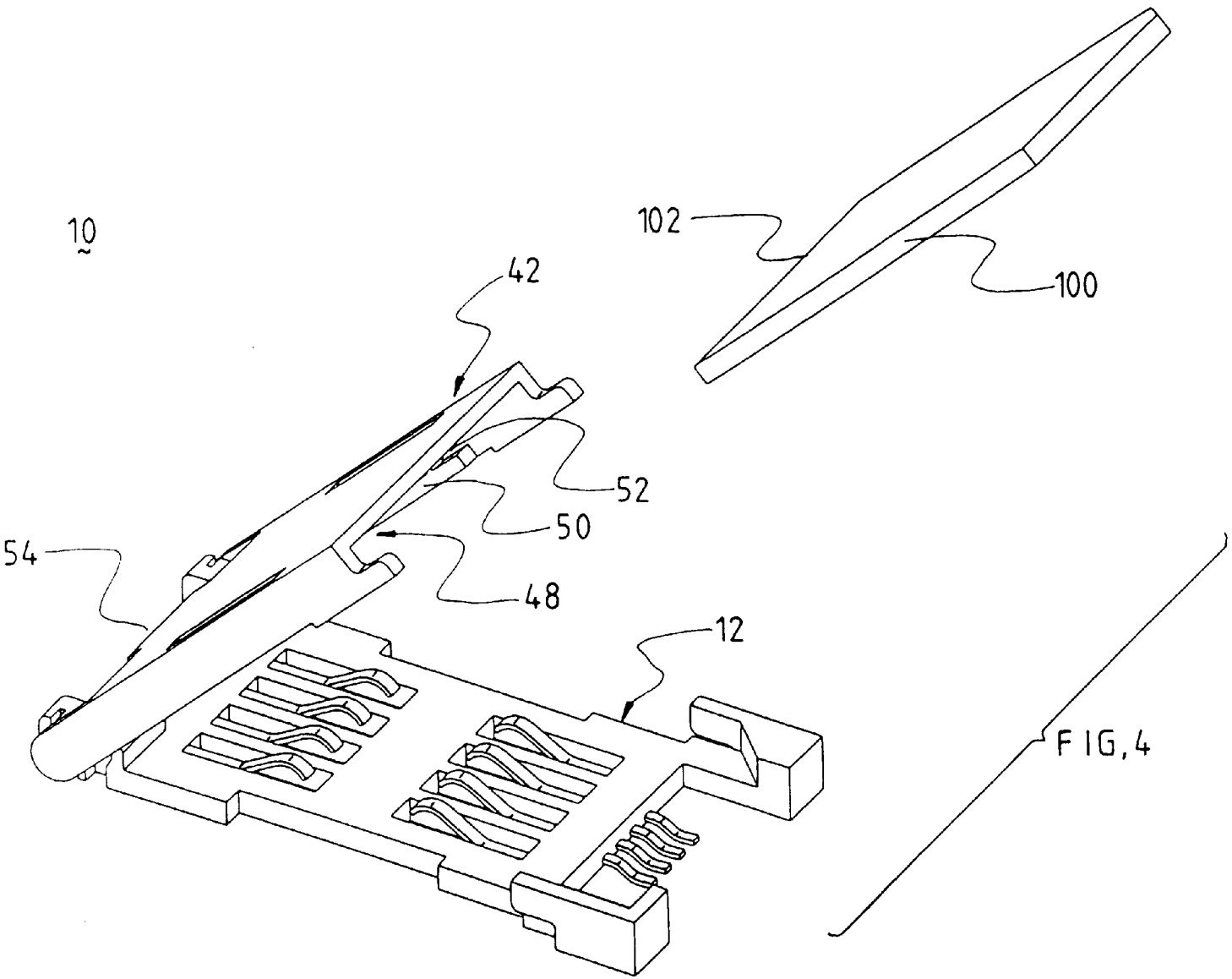
FIG. 4 is a perspective view of the assembled connector and the IC card of FIG. 1 wherein the cover is in a slanted state with regard to the base for being ready to receive the IC card therein.
Figure 5:
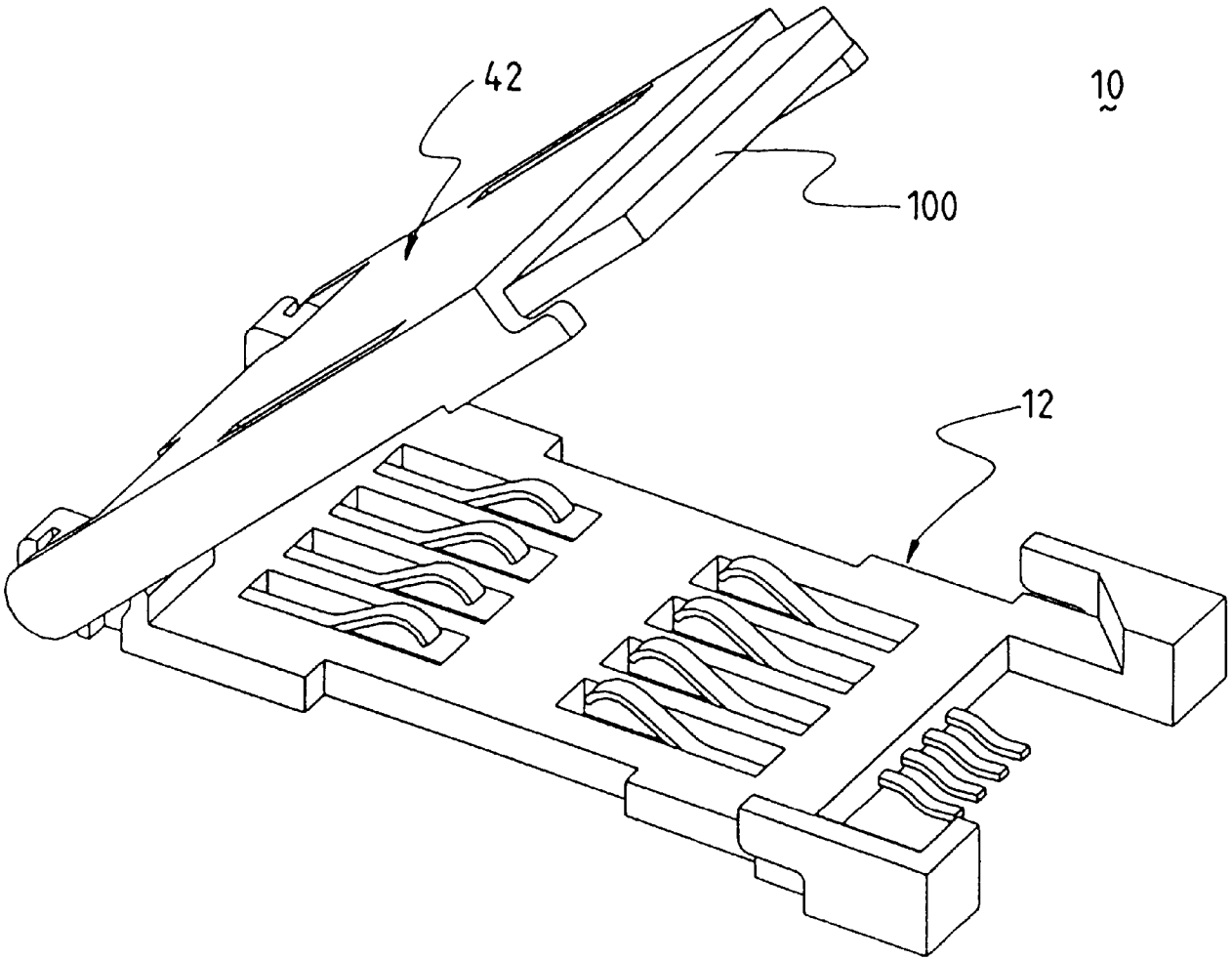
FIG. 5 is a perspective view of the assembled connector of FIG. 1 wherein the cover is in a slanted state and the IC card has been inserted thereunto.

With reference to FIGS. 4 and 5, in a common application, the cover 42 is rotated to a slanted position, which is generally at forty-five degrees with regard to the base 12, for waiting for insertion of the IC card 100. The IC card 100 can be inserted into the two opposite slots 52 of the cover 42 until the front end 102 of the IC card 100 confronts the pushing bar 54 of the cover 42 and the IC card 100 is substantially received within the space 48 of the cover 42.

Figure 6:
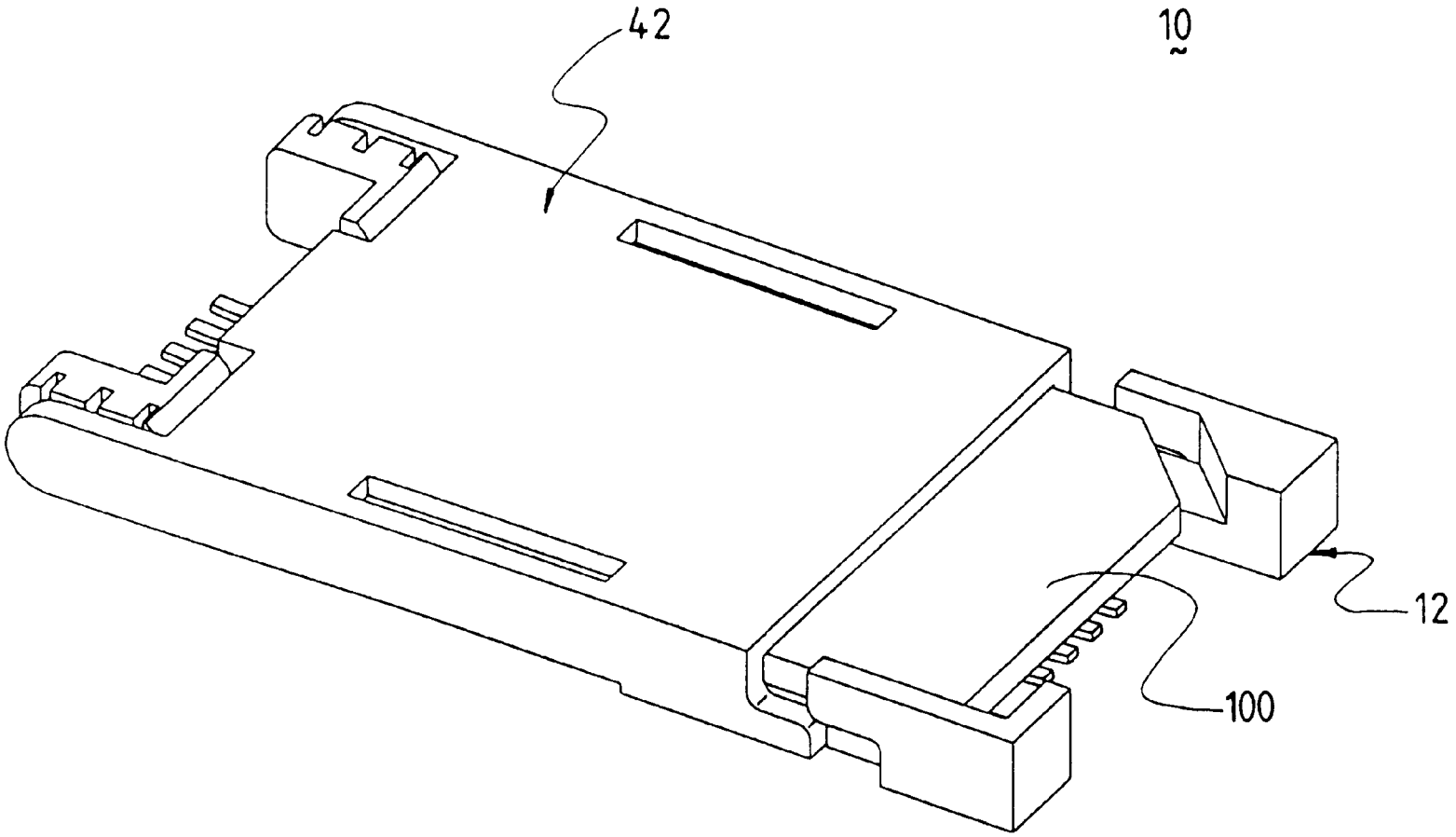
FIG. 6 is a perspective view of the assembled connector with the associated IC card of FIG. 1 wherein the cover is in a rear horizontal position.
Figure 7:
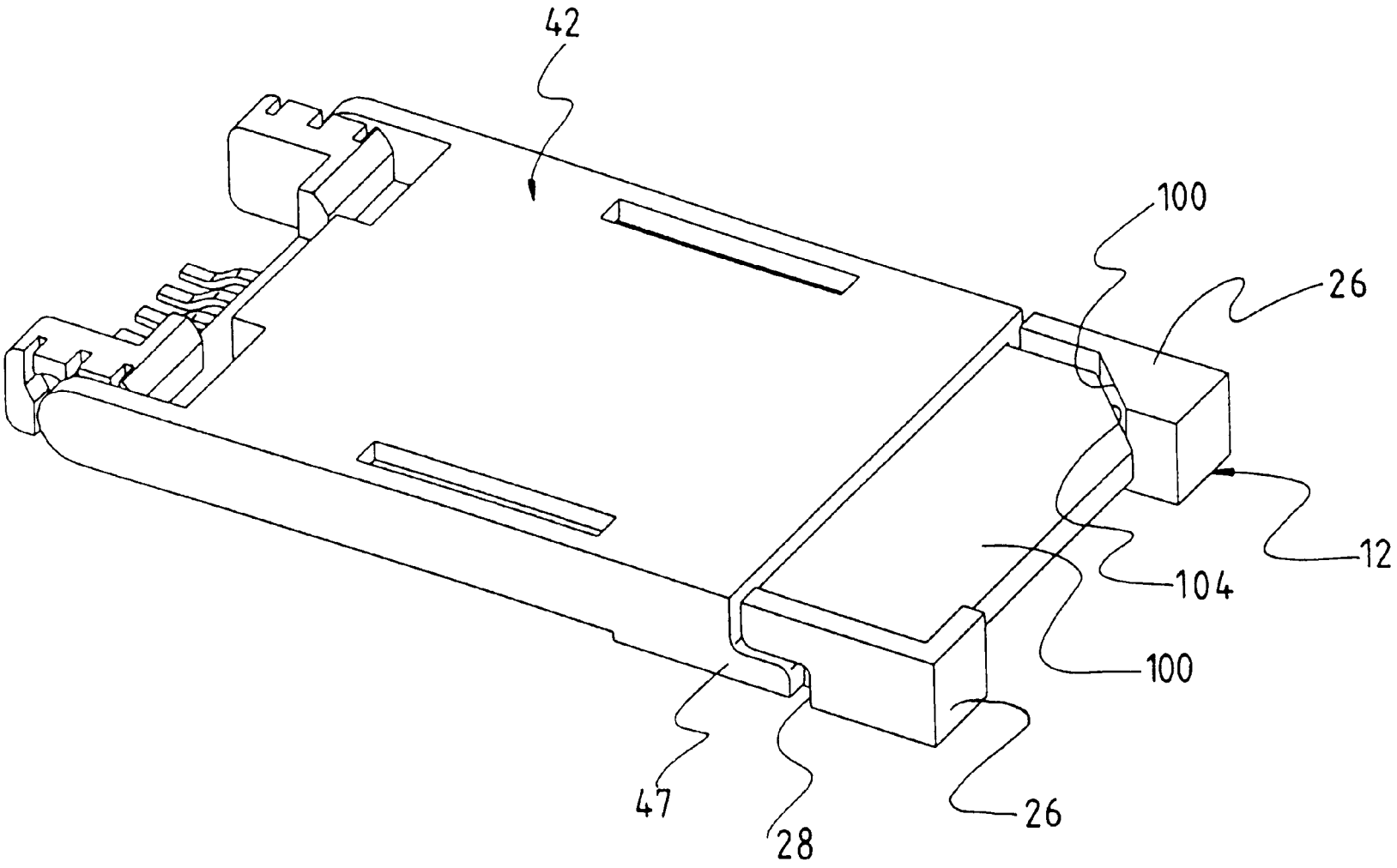
FIG. 7 is a perspective view of the assembled connector with the associated IC card of FIG. 1 wherein the cover is in a front horizontal position.

Successively, as shown in FIG. 6, the cover 42 with the associated IC card 100 is downward rotated toward the base 12 until the cover 42 is substantially seated on the base 12. Lastly, as shown in FIG. 7, the cover 42 with the associated IC card 100 is horizontally moved forwardly with regard to the base 12. Under this situation, by applying a proper pull force thereto, the shaft 56 in the portion A of the recess 34 may pass the dimension-reduced narrow waist of the recess 34 and enter the front portion B (as shown by Arrow B in FIGS. 1–3) of the recess 34. Simultaneously and naturally, the restriction projections 47 of the cover 42 enter the corresponding indents 28 of the base 12, and the associated IC card 100, which is synchronously moved with the cover 42 forwardly due to the pushing bar 54 of the cover 42, substantially confronts the restraint blocks 26 on the base 12 wherein the polarization region 104 of the IC card 100 abuts against the chamfer region 30 of one restraint block 26.

It can be seen that the cover 42 is locked with regard to the base 12 by means that the restriction projections 47 and the shaft 56 of the cover 42 are respectively received within the indents 28 and the portion B of the recesses 34 of the base 12. Moreover, the IC card 100 is restricted in the slots 52 in both vertical and left-to-right directions, and is restrained in a front-to-back direction by the pushing bar 56 of the cover 42 and two restraint blocks 26 of the base 12. Thus, the IC card 100 can be securely seated in the cavity 24 of the base 12 whereby the circuit pads (not shown) disposed on the underside of the IC card 100 can mechanically and electrically engage the engagement portions 20 of the corresponding contact 16, respectively, for achievement of verification purpose.

It can be noted that a reverse process can be applied thereto to remove the IC card 100 from the connector 10.

It can be understood that in the invention, the IC card 100, which is synchronously moved with the cover 42, is substantially horizontally moved in a rear-to-front direction with regard to the base 12, so that a wiping action can be obtained between the circuit pads and the engagement portions 20 of the contacts 16 for better conductivity thereof. Further mover, the IC card 100 is restricted in the front-to-back direction by cooperation of the pushing bar 56 of the cover 42 and the restraint blocks 26 of the base 12, respectively, thus making it efficient to precisely position the IC card 100 within the connector 10 by designedly arranging the relative movement between the cover 42 and the base 12.

Referring FIG. 1, it is also appreciated that the holding straps 50 are provided with some ribs thereon for properly holding the corresponding IC card 100 in the slots 52. The base 12 includes two notches 60 on two sides for receiving such holding straps 50 of the cover 42 therein and allowing the movement of such straps 50 thereof. The narrow waist shaped recesses 34 of the piers 32 of the base 12 also provide the advantages of easy fabrication of the base 12 itself and the smooth operation of the cover 42 with regard to the base 12 which includes a stable movement when the cover 42 is horizontally moved with regard to the base 12 and a properly significant restriction for limiting the cover 42 in its locked position with regard to the base 12.

While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A connector for use with an IC card comprising:

a base defining a cavity receiving a plurality of contacts each of which forms an engagement portion upward extending into said cavity, and a pair of piers formed on a rear portion of the base and each pier having a recess which is divided by at least a raised bottom peg into a first portion and a second portion thereon and defined with a narrowed waist to respectively communicate with both the first and second portion, and a pair of restraint blocks formed on a front portion of the base;

a cover including a pair of shafts which are received within the corresponding recesses of the piers to attach the cover to the base, and at least a holding strap formed on a side arm of the cover, and a pushing bar formed on a rear portion of the cover whereby the shafts of the cover are designedly located in the first portions of the recesses of the base to allow rotation of said cover with regard to the base and reception of said IC card in the cover until said cover with the received IC card is rotated to a horizontal position, so as to allow the shafts of the cover to enter the second portions of the recesses of the base via the narrowed waist, and the cover with the received IC card horizontally moves together with regard to the base to reach a position where said IC card is substantially restrained by said pushing bar of the cover and the restraint blocks of the base.

2. The connector as defined in claim 1, wherein said recess is defined with two top arc walls and two converged side walls.

3. The connector as defined in claim 1, wherein said holding strap defines a slot for receiving the IC card therein.

4. The connector as defined in claim 1, wherein said cover further includes a pair of restriction projections for reception within a pair of corresponding indents in the base.

5. A connector for use with an IC card, comprising:

a base having a plurality of contacts therein for engagement with circuit pads on the IC card;

a cover adapted to be pivotably attached to the base and comprising a holding strap, a pushing bar and a restraint block;

at least a pair of restriction projections formed in the cover; whereby by means of said holding strap, said IC card can be retainably received within the cover and further rotated downward with the cover with regard to the base until said IC card and the cover are seated on the base and synchronously moved horizontally by means of said pushing bar of the cover to reach where the inserted IC card can be securely and directly sandwiched between the cover and the base for maintaining the reliable engagement between the contacts and the circuit pads on the IC card, by means of cooperation between said restriction projections and the base, and the IC card is further precisely restrained in a front-to-back direction by means of cooperation between the pushing bar of the cover and restraint block of the base.

6. An arrangement of securely installing an IC card into an electrical connector, comprising:

a base of said connector having a plurality of contacts thereof and defining a cavity therein for receiving said IC card therein, and at least a restraint block formed on a front portion thereof; and a cover of said connector having a pushing bar formed on a rear portion thereof, and a pivotal shaft designedly pivotably located at a first position with regard to said base to receive the IC card at different angles with regard to the base wherein as soon as the cover and the inserted card are rotated to sit on the base, the pivotal shaft of the cover can be horizontally moved from the first position to a second position with regard to said base so that said pushing bar of the cover and the restraint block of the base efficiently and precisely position the IC card within said cavity of the base in a front-to-back direction and the cover is synchronously locked by locking of the cover with regard to the base.

* * * * *